US005683609A

United States Patent [19]

Schwörer

[11] Patent Number: 5,683,609

[45] Date of Patent: Nov. 4, 1997

[54] CEILING MOLD SUPPORT

[75] Inventor: Artur Schwörer, Senden, Germany

[73] Assignee: Peri GmbH, Germany

[21] Appl. No.: 432,192

[22] PCT Filed: Oct. 13, 1993

[86] PCT No.: PCT/DE93/00982

§ 371 Date: May 2, 1995

§ 102(e) Date: May 2, 1995

[87] PCT Pub. No.: WO94/11594

PCT Pub. Date: May 26, 1994

[30] Foreign Application Priority Data

Nov. 6, 1992 [DE] Germany ..... 42 37 516.9

[51] Int. Cl.[6] ..... E04G 11/52

[52] U.S. Cl. ..... 249/18; 249/19; 249/22; 249/24; 249/210; 249/211

[58] Field of Search ..... 249/18, 19, 22, 249/24, 210, 211

[56] References Cited

U.S. PATENT DOCUMENTS

| | | | |
|---|---|---|---|
| 776,419 | 1/1904 | Platt | 404/43 |
| 1,907,877 | 5/1933 | Roos | 249/193 |
| 2,401,587 | 6/1946 | Smith | 52/474 |
| 3,385,557 | 5/1968 | Rambelle | 249/210 |
| 4,280,677 | 7/1981 | Shabar | 249/210 |

FOREIGN PATENT DOCUMENTS

| | | | |
|---|---|---|---|
| 2479411 | 10/1981 | France . | |
| 1534852 | 8/1971 | Germany . | |
| 3004245 | 8/1981 | Germany | E04G 11/48 |
| 3117861 | 11/1982 | Germany . | |
| 3004245 | 1/1987 | Germany . | |
| 3544544 | 5/1987 | Germany . | |
| 1233058 | 5/1971 | United Kingdom . | |

*Primary Examiner*—Thomas R. Weber
*Attorney, Agent, or Firm*—Walter A. Hackler

[57] ABSTRACT

The invention concerns a support for ceiling mold elements for concrete. It is effected in that, on both edges of its upper surface (2, 48) one row each of projections (3, 4, 53, 54) is provided for, the projections protruding upwardly and outwardly at separations from another and being suited for securing or attaching the ceiling mold elements (11, 29, 30) and in that the spaces between the projections (3, 4, 53, 54) correspond to twice the separation of an abutment, arranged on the underside of the mold element, from the edge of the mold element, and in that the distance between the projections (3, 4, 53, 54) matches the corresponding dimension of the mold element (11, 29, 30) to be placed in, or a fraction of this dimension. The invention furthermore provides for the surfaces of the support to be at least partially covered with a plastic cover strip.

17 Claims, 2 Drawing Sheets

CEILING MOLD SUPPORT

BACKGROUND OF THE INVENTION

The invention concerns a concrete ceiling mold having ceiling mold elements and their support, whereby the support exhibits separated rows of projections, the projections being arranged at separations from each other and protruding largely upwardly and outwardly.

A support for concrete ceiling molds of this kind is known in the art from DE-PS 30 04 245 (compare FIG. 4, 5; description column 14, line 26 through column 15, line 20) with flanges running along its longitudinal sides for the placing on of mold elements or panels which are configured as mold frame plates. The flanges are located at approximately half the height of the support. The side of the mold element shell facing the concrete is coplanar with the upper surface of the support so that the supports are imprinted on the under part of the completed concrete ceiling. This is often undesirable. The supports which are thereby necessary are often equipped with a retractable head so that, after a certain period of time, it is possible that the carriers with the mold elements could settle out of the mold configuration so that only the head of the reinforcement continues to support the ceiling.

In order to, with these known molds, prevent a sideward slippage of the utilized mold elements from the flanges, these flanges exhibit a plurality of toes facing in the upper and in the outer directions along the length of support which engage the frame of an inlaid mold element. When placing on the mold element an intermediate space often results between the mold element which has already been put on and the subsequent mold element which must be eliminated by pushing together the last mold element placed.

The underlying purpose of the invention is to effect a support for a ceiling mold in such a manner that a uniform concrete imprint is given to the underside of the ceiling and that the placing on of the mold elements is simple.

SUMMARY OF THE INVENTION

This purpose is achieved in accordance with the invention in that, on both edges of the upper surface of the support, a series of projections are provided for that extend largely upwards and outwards and are arranged at a separation with respect to each other, the projections being adapted for confining or fixing the mold elements, and in that the separation between the projections exhibits twice the separation of an abutment arranged on the underside of the mold element from the edge of the mold element and the separation of the projections from each other corresponds to the length of the side of the mold element which is to be placed on or to a fraction of this dimension.

This configuration has the advantage that the mold elements in the gap between the two projections lie in close proximity to another even when placing on the mold elements, so that a sliding repositioning of the mold elements is not necessary. Furthermore, the mold elements lie on top of the carrier so that they no longer are imprinted on the bottom part of the concrete. By means of the invention, and due to the inventive dimensioning of the gaps, the mold elements between two projections lie, as seen in the longitudinal direction of the support, in close proximity to each other. A particular advantage of the invention is that it can be used to assemble ceiling molds with which all mold elements can be removed by lowering of the support with the assistance of a retractable head.

A strut shaped support for walk-way plates has become known in the art through U.S. Pat. No. 776,419 which is supported at its two ends on posts embedded in the earth and which exhibits two rows of right-angled projections protruding upwardly at the middle of its upper surface upon which the edges of neighboring walk-way plates are placed. Large gaps are provided for in each row at separations from a side length of the walk-way plates into which the downwardly protruding projections, arranged on the corners of the walk-way plates, can engage. These materials are, due to their dimensions alone, not comparable to supports for concrete molding elements for ceilings since these supports must accept a significantly greater load than supports for walk-way plates. In addition the walk-way plates must be placed on their supports in such a fashion that the projections extending downwardly at the plate corners engage into the gaps of the teethed row provided therefor. A displaced placing of the walk-way plates for the support in a longitudinal direction is not desirable since, in this case, the downwardly extending projections on the corners of the walk-way plate can no longer engage into the openings and therefore the plates are not fixed in the longitudinal direction of the support or are not flush with the plates whose projections engage into the openings.

An intermediate space between a longitudinal row of mold elements and the neighboring longitudinal row of mold elements can be bridged by means of a cover plate or other known means. In an embodiment of the invention the separation between both rows of projections corresponds however to twice the distance of the abutment, provided on the bottom side of the mold element, from the edge of the mold element. In this fashion the placed mold elements also lie in close proximity to another in a direction transverse to the longitudinal extension of the support. A very smooth and uniform concrete surface is fashioned on the bottom side of the ceiling.

The abutment which is provided for on the underneath part of the mold element can be realized by means of a special element. In an embodiment of the invention the inner surface of the frame piece of the mold element comprises such an abutment. The separation from this inner surface to the border of the construction element can be larger than the back surface of the frame of the mold element if the border of the mold element protrudes out over the frame piece and if, by way of example, a drip extension is provided for on the protruding edge. Thereby, depending on the configuration of the mold element, the separation between two neighboring projections in the longitudinal row can exhibit a different dimension than the distance between the two longitudinal rows if the corresponding dimension is different at differing edges of the mold element.

In an embodiment of the invention with which ceiling mold elements are utilized whose edge does not extend beyond the frame piece, the separation between two serially adjacent projections and the separation between the two rows each correspond to twice the thickness of the part, engaging between the projections, of the mold element frame which is to be placed on the support.

In an embodiment of the invention the projections are tapered towards the top so that the gaps between the projections exhibit V-shaped sides which widen upwardly so that, when positioning the mold element, its frame piece is guided into the proper position.

Cleaning of the wooden or metal supports from residual concrete is often time consuming and tedious. One had attempted to simplify the cleaning process in that one coated the metal portions of, for example, the supports with a powder. This known powder layer is, however, relatively soft so that it is often damaged when removing the concrete, exposing the underlying bare metal.

In accordance with further developments of the invention a support for ceiling mold elements is characterized in that a plastic layer of, preferentially, tough elastic plastic is provided for at least on its upper surface. Such a layer of tough elastic plastic is rarely damaged when cleaning the support. Moreover, it has the advantage that, in an embodiment of the invention, this plastic layer can be provided with the above mentioned projections in an extremely simple fashion. By way of example the plastic layer can be applied to the support by means of extrusion, and the projections can subsequently be machined out.

In embodiments of the invention, the plastic layer is composed, however, from a prefabricated plastic cover strip which is fastened to the support. A prefabricated plastic cover strip can be provided in a particularly simple fashion with the above mentioned projections.

In embodiments of the invention, the plastic cover strip can also be attached to the support in a replaceable fashion. This is not only advantageous for renewing the plastic cover strip, but also allows the supports to be retro-fit when other ceiling mold elements are to be placed upon them which have a separation between the inner surface of a frame or of an abutment and the edge of the ceiling mold element which is different than that of a mold element which was previously placed upon the support.

The securing of a prefabricated cover strip onto the support can transpire in various ways: the molding can for example be riveted or glued to the support. In an embodiment of the invention however, the support exhibits, on its side-walls at least one relief in which the molding, for purposes of its attachment, lockingly engages.

In embodiments of the invention, the cover strip can be slidingly mounted to the support along its longitudinal direction.

Although cement in general does not bind to a layer of water repellent plastic, plastic compositions are at least known to which cement slurry does not bind or binds only poorly. In order to further simplify the cleaning of the plastic layer, in one embodiment of the invention, some play is provided for between the plastic layer and the support surface so that at least several intermediate spaces having, for example, the dimensions of the play or of larger production tolerances are formed, the intermediate spaces providing for some small degree of motion of a section in a direction perpendicular to the metal surface. In this case a light tapping on the plastic section is sufficient to flake-off the remaining cement.

If the support is made out of wood, the plastic cover strip can be nailed to the support.

Further characteristics of the invention can be derived from the following description of embodiments of the invention in combination with the claims and with the drawing. The various features can be realized individually or collectively in embodiments of the invention.

In the drawing important portions of embodiments of the invention are represented in order to facilitate understanding of the invention.

DESCRIPTION OF THE PREFERRED EMBODIMENT

Figure 1:
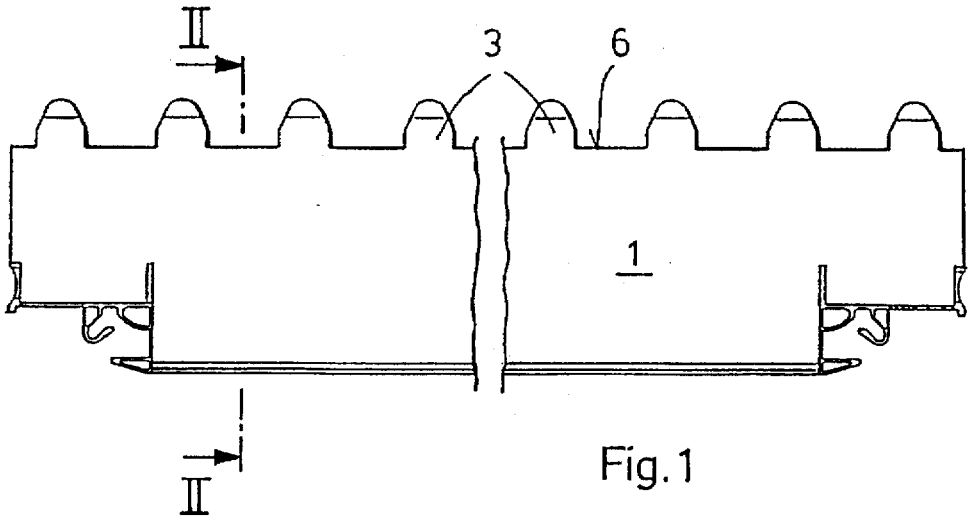
FIG. 1 shows a side-view of a first embodiment of the support in accordance with the invention.
Figure 2:
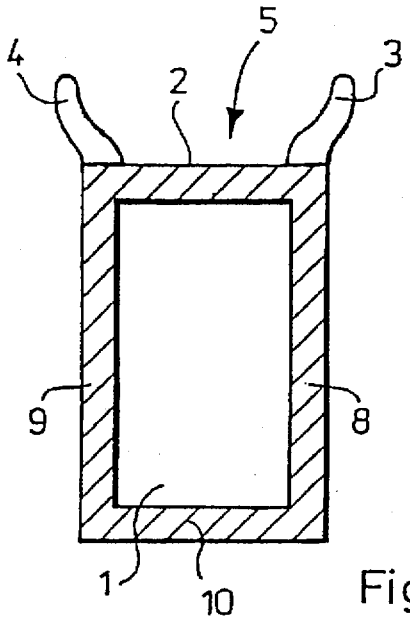
FIG. 2 shows a cut along the line II—II in FIG. 1.
Figure 3:
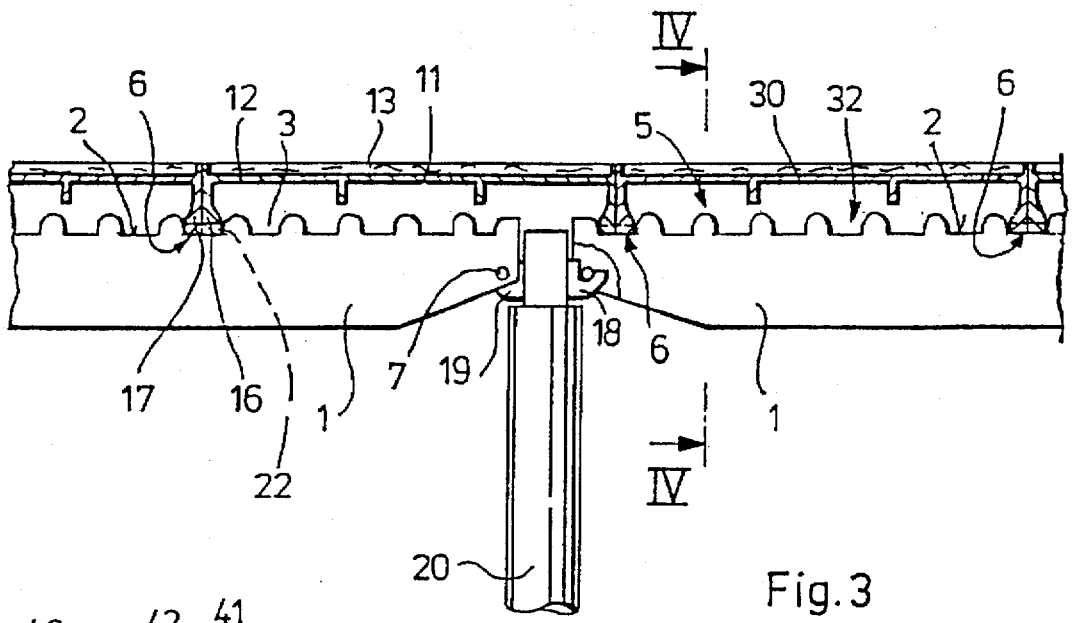
FIG. 3 shows a view, partially sectional, of a ceiling mold.

The support 1 shown in FIGS. 1, 2, and 3 is produced by extrusion from an aluminium alloy. Its cross section exhibits a hollow rectangular profile. On each of the two lengthwise corners of the upper side 2 of the support 1, projections 3, 4 are formed which extend along the entire length of the support 1 and form rows which extend obliquely upwards and outwards. They form together with the upper side 2 of the support 1 a groove 5 along the entire length of the support 1. The groove 5 serves to accept the mold elements 11, 29. It has, at the bottom, twice the width of a frame piece 14, 15 of a mold element 11, 29 at the side of the mold element which is facing away from the molding shell, the frame piece running parallel to the lengthwise axis of the support. The projections 3 or 4 define the recesses 6 which taper towards the bottom. Their clearance width at the bottom corresponds to twice the width of a frame piece 16, 17 (FIG. 3), running transverse to the lengthwise axis of the support, of a mold element 11, 30 which is to be placed in the groove 5 on the side opposite the molding shell. The recesses 6 are so arranged that a modular dimension results when a support construction for ceiling mold elements is assembled from supports 1 and appropriate reinforcements. The separation of the recesses 6 from another corresponds to a fraction of the corresponding dimension of a mold element 30. In the embodiment shown in FIG. 3, for example, is one seventh of the width of a mold element 30. The support 1 is provided with a suspension device on each of its two ends, for reasons of clarity represented in FIG. 3 as simple suspension bolts 7, which runs transversely through both sidewalls 8, 9 of the support 1 and projects out on both sides.

Figure 4:
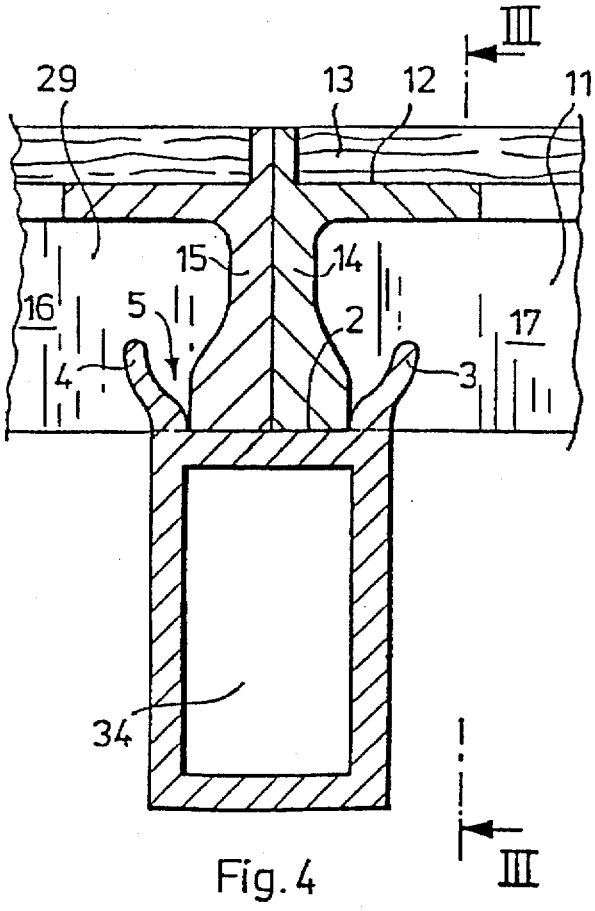
FIG. 4 shows a section along line IV—IV in FIG. 3.

FIG. 4 shows the support 1 having the groove 5 and with the mold elements 11 and 29 placed on its upper side 2. The mold elements 11 and 29 exhibit a frame 12 onto which a molding shell 13 is attached. The frame 12 is comprised, for example, from welded aluminium sections. One frame 12 leg 14, 15 each of two directly adjacent mold elements 11, 29 are accommodated next to another in each groove 5 (compare FIG. 4). The groove 5 tapers towards the bottom. The mold elements 11, 29 abut under some tension, depending on the widths of the bottom of the groove, and of both legs 14, 15 of the mold elements 11, 29.

The recesses 6 in the projections 3, 4 of the groove 5 are penetrated in the direction transverse to the support 1 by legs 16, 17, of the frame 12 of each of two mold elements 11, 30 (compare FIG. 3). Since the recesses 6 are also tapered towards the bottom, the frame pieces 16, 17 also are mutually adjacent. A choice of the clearances of the recesses 6 on the upper side 2 of the support 1 also permits the frame pieces 16, 17, of the mold elements 30 and 11 to abut under some tension (FIG. 3).

In general, all mold elements of a ceiling mold lie in the longitudinal as well as in the transverse direction in close abutment to another; a continuous and smooth molding surface is obtained as shown in FIG. 3 and 4.

In FIG. 3, the supports 1 are suspended in hanging means 18, 19 of a reinforcement 20. The hanging means 18, 19 are hook-shaped; they engage the inside of the hollow section of the support 1 and each accept one suspension bolt 7. The hanging means 18, 19 can also be so configured that they accept one suspension bolt on the outside of support 1 at its sidewards protruding ends.

To erect a ceiling mold with the inventive supports 1 the supports 1 are initially suspended in the reinforcements 20 in such a fashion that a plurality of rows of supports 1 and reinforcements 20 result which are next to another and are separated by the length of the mold elements to be placed in. Mold elements 11, 29, 30 are placed on this standing reinforcement assembly.

In the embodiments of the invention shown the length of the recess 6 corresponds to twice the thickness of the engaging frame 12 part 16, 17 of the mold elements 30, 11 which are to be placed on the support 1. If however the edge of the mold element extends out over the frame piece 16 or 17, the recess 6 must exhibit twice the length of the dimension from the inner surface of the frame piece 16 to the edge of the mold element.

Figure 5:
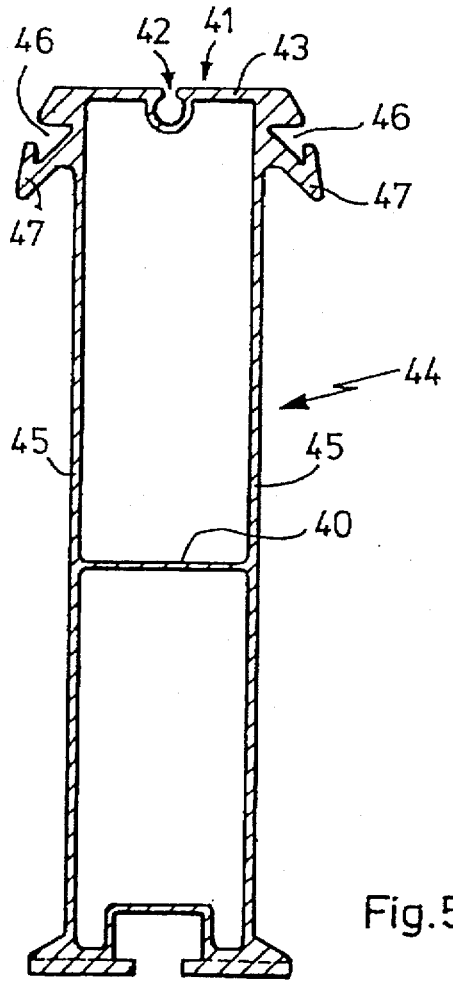
FIG. 5 shows a cut corresponding to FIG. 2 through another embodiment of the support in accordance with the invention.

FIG. 5 shows a cross section through another embodiment of a support. It displays a closed rectangular cross section which is subdivided by a wall 40. The lower edge of the cross section and the ends of the support exhibit a special form which allows the support to be used in connection with various reinforcement heads. The support exhibits a smooth surface 41 on its upper edge in the longitudinal middle plane of which a longitudinal groove 42, extending along the entire length of the support, is provided whose sides, at their upper ends, exhibit a smaller separation from another than the largest diameter of the groove. The upper wall 43 of the support 44 protrudes beyond the side walls 44 of the support and exhibits there an approximately dovetailed relief 46. Adjacent to each relief is one extension 47 which projects downwards and which can be configured as a drip-extension.

Figure 6:
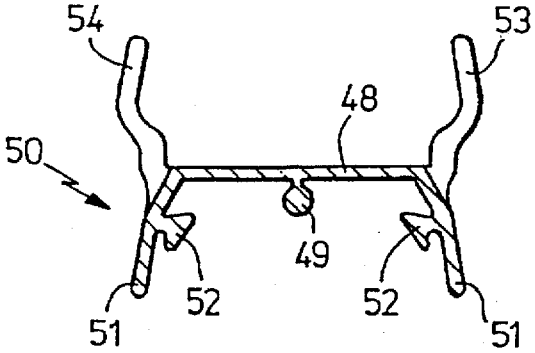
FIG. 6 shows a cover strip for the support of FIG. 5.

The plastic cover strip 50 shown in FIG. 6 is slid onto the upper surface 41 of the support 44 so that its central projection 49, which protrudes downwards from the flat section 48 of the plastic molding engages the groove 42 and secures, at this location, the section 48 to the surface 41. The molding 50 exhibits legs 51 on its longitudinal sides, which extend downward and which seat on and cover the cover strips slid onto the support 44 at the extensions 47. Projections 52 which protrude inwardly engage, after sliding on the molding 50, the dovetail-shaped reliefs 46 and closely hold the legs 51 to the extensions 47 at these locations. The molding 50 exhibits a row of projections 53 and 54 along each edge of the flat molding section 48 whose shape and whose separation from each other correspond to the projections 3 and 4 according to the embodiment of FIGS. 1 and 2.

The embodiments of FIGS. 5 and 6 thereby distinguish themselves from the embodiments according to FIGS. 1 through 4 in that the projections 3 are not formed on the alluminium alloy support 44, rather on a cover strip 50 which is made from a tough elastic plastic and which is attached to the upper part of the support 44. When sliding the cover strip molding 50 onto the support 44, the cover strip section 48 seats more or less tightly on the upper surface 41 of the support. The small intermediate space which occurs after the sliding on procedure between the cover strip section 48 and the support surface 41 facilitates a small relative motion of the section 48 with respect to the support surface 41, which is sufficient to allow the lightly bound concrete pieces on the section 48 to be removed. The leg 51 stretches sidewards beyond the support 44 to thereby shield the side surface of the support from concrete pieces and cement slurry. Thereby the downwardly protruding projections 47 and the legs 51 form, at their ends, a drip extension onto which the cement slurry drips to prevent it from reaching the side surfaces of the support 44. The separation of the rows of the projections 53 and 54 corresponds to the distance between the rows of the projections 3 and 4 in the embodiment according to FIGS. 2 and 4, the role of the support 44 corresponding to the role of the support 1.

If a support is made out of wood it is then possible for a plastic cover strips, which can likewise exhibit legs extending downward, to be nailed onto the wooden support in order to protect the sides of the support.

The plastic molding 50 protects all surfaces of the carrier which come into contact with concrete or cement slurry splashes so that, prior to re-use of the support, only the surface of the tough elastic plastic must be cleaned, which is much easier to realize than a cleaning of a metal surface. Thereby there is no danger of damaging the surface of the tough elastic plastic.

The projections prevent a slippage of the mold elements on the supports so that the mold elements are pulled together and remain firmly together. If the projections are made from plastic, it is possible for them to be configured to be elastic. The spring action resulting from this elasticity contributes to holding the elements firmly together.

Embodiments of the support exhibit a length of 2190 mm, a height to the upper side 2 of 164 mm and a width of the rectangular hollow section of 60 mm. The axis dimension of the reinforcement construction, e.g. from the middle of a reinforcement 20 to the middle of the next reinforcement 20, is 2250 mm. Another embodiment of the support has a length of 1440 mm, and the axis dimension is then 1500 mm. The dimension from the middle of a recess 6 to the middle of the next recess 6 assumes, for example, a value of 125 mm.

In further embodiments of the invention, more or less of the (metal or wood) surface of the support can be jacketed with a layer of plastic which exhibits a water repellent surface.

For example using known supports, with which the projections are arranged not on the top but rather on the sides of the supports, these projections and, possibly, the surfaces of the support bordering these projections, can be jacketed in plastic which furthermore can be effected by means of a plastic cover strip attached to the support. Here it is also possible for the projections not only to be jacketed with plastic rather to be made completely from plastic.

I claim:

1. Concrete ceiling molding means comprising:

a support having first projections arranged at first separations from each other in a first row and having second projections arranged in a second row, the first and the second rows being located along a first and a second edge of an upper surface of the support, the first and second rows protruding generally upwardly and outwardly from the upper surface to define a volume having a U-shaped cross section; and a molding element having a side-length and an abutment arranged on an underside of the molding element, the abutment having a second separation from a first edge of the molding element, the abutment being adapted to fit between the first separations, the first separations being two times as large as the second separations and an integral number of first and second projections are evenly spaced along the side-length.

2. The molding means of claim 1, wherein the abutment has a third separation from a second edge of the molding element and the first and the second rows have a fourth separation from each other, the abutment being adapted to fit between the fourth separation, the fourth separation being two times as large as the third separation.

3. The molding means of claim 1, wherein the mold element comprises a frame having an inner surface functioning as the abutment.

4. The molding means of claim 1, wherein the projections are upwardly tapered.

5. The molding means of claim 1, further comprising a plastic layer provided for on the upper surface of the support.

6. The molding means of claim 5, where the projections are made from plastic.

7. The molding means of claim 5, wherein the plastic layer comprises a prefabricated cover strip attached to the upper surface of the support.

8. The molding means of claim 7, wherein the cover strip is attached to the support in a removable fashion.

9. The molding means of claim 7, wherein the support has a recess on a side wall adapted to receive the cover strip.

10. The molding means of claim 7, wherein the cover strip is adapted to slide onto the support in a lengthwise direction.

11. The molding means of claim 5, wherein at least one of a lower surface of the plastic layer and the upper surface of the support have recesses to permit a limited motion of the plastic layer in a direction perpendicular to the upper surface.

12. The molding means of claim 5, wherein the support comprises wood and the plastic cover strip is nailed thereto.

13. The molding means of claim 1, further comprising drip extensions formed along the first and second edges of the support.

14. The molding means of claim 5, wherein the plastic layer covers part of a side surface of the support at the first and second edges.

15. The molding means of claim 14, wherein the plastic cover strip comprises drip extension legs partially covering the side walls of the support.

16. The molding means of claim 14, wherein the plastic cover strip comprises downwardly projecting drip extension legs covering the support.

17. The molding means of claim 5, wherein the plastic layer jackets at least one of the upper surface and the projections.

* * * * *